United States Patent [19]

Sanders

[11] Patent Number: 4,572,932

[45] Date of Patent: Feb. 25, 1986

[54] ACTUATING MECHANISM

[75] Inventor: Peter G. Sanders, Frome, England

[73] Assignee: Rotork Controls Limited, England

[21] Appl. No.: 479,201

[22] Filed: Mar. 28, 1983

[30] Foreign Application Priority Data

Apr. 23, 1982 [GB] United Kingdom ..... 8211885

[51] Int. Cl.[4] ..... H01H 3/00

[52] U.S. Cl. ..... 200/17 R; 200/18; 200/153 R

[58] Field of Search ..... 74/526, 110; 200/17 R, 200/18, 38 R, 153 R

[56] References Cited

U.S. PATENT DOCUMENTS

| | | | |
|---|---|---|---|
| 3,230,321 | 1/1966 | McCann | 200/17 R X |
| 3,612,789 | 10/1971 | Marquis et al. | 200/17 R |
| 4,288,665 | 9/1981 | Smith | 200/18 |

*Primary Examiner*—J. R. Scott

*Attorney, Agent, or Firm*—Hayes, Davis & Soloway

[57] ABSTRACT

An actuating mechanism for example for an electric switch comprises a driving member, a driven shaft and a transmission gearing through which the driven shaft is driven by the driving member through a certain angle of rotation after a predetermined number of revolutions of the driving member. An actuator carried by the driven shaft is operative at a predetermined angular position of the driven shaft. An adjustment shaft is provided which can be rotated to rotate the driven shaft through the transmission gearing, a clutch being connected between the driving member and the transmission gearing to permit by disengagement of the clutch the adjustment shaft to rotate the driven shaft relatively to the driving member. A radial projection, e.g. an arm, is provided on the driven shaft in a fixed angular relationship to the actuator thereon, and a removable abutment stop for the radial projection is provided at a predetermined angular position with respect to the axis of the driven shaft to limit the angular displacement of the driven shaft by the adjustment shaft.

7 Claims, 4 Drawing Figures

ACTUATING MECHANISM

BACKGROUND OF THE INVENTION

This invention relates to an actuating mechanism, such as a switch actuating mechanism of the kind comprising a driving member (e.g. a gear member), a driven shaft and a transmission means through which the driven shaft is driven by the driving member through a certain angle of rotation after a predetermined number of revolutions of said driving member, and actuating means carried by said driven shaft and operative at a predetermined angular position of said driven shaft. Such an actuating mechanism is described for example as the counting mechanism in U.S. Pat. No. 4,288,665.

An actuating mechanism of the above kind has application in valve actuators for opening and closing mechanically operated valves. Such valve actuators generally have an output shaft rotatable by an electric motor and drivingly connected to the valve stem. It is conventional to control the energisation of the electric motor at predetermined positions in the travel of the valve in both the opening and closing directions, e.g. at limit positions and predetermined intermediate positions. As actuating mechanism in accordance with the invention can be used to provide such control or to monitor the valve actuator operation in that its driving member can be connected for rotation in a fixed ratio with the valve actuator output shaft and its actuating means arranged to actuate "limit" and/or "intermediate" switches at appropriate points in the travel of the valve stem.

One of the problems with actuating mechanisms of the kind described lies in their adjustment in order to set them up so that their actuating means is operative precisely at a desired point in the travel of the driving member, particularly where the actuating mechanism is used in an environment in which the position of the actuating means cannot be seen as is sometimes the case with valve actuators. The object of the invention is to provide a solution to this problem.

According to the invention, in an actuating mechanism of the kind described an adjustment shaft is provided which can be rotated to rotate the driven shaft through the transmission means, a clutch is connected between the driving member and the transmission means to permit by disengagement of the clutch the adjustment shaft to rotate the driven shaft relatively to the driving member, a radial projection is provided on the driven shaft in a fixed angular relationship to the actuating means thereon, and a removable abutment stop for said radial projection is provided at a predetermined angular position with respect to the axis of the driven shaft to limit the angular displacement of said driven shaft by said adjustment shaft.

Thus with the driving member set at a desired position the adjustment shaft and hence the driven shaft can by virtue of the clutch be rotated relatively to the driving member and such rotation can be continued until the radial projection on the driven shaft comes up against the abutment stop to set the actuating means at a predetermined position for the set position of the driving member. The abutment stop is then removed so that the radial projection and hence the driven shaft can rotate freely.

Conveniently the abutment stop can be provided by a handle fitted to the adjustment shaft for rotating it manually. For example if the handle is in the form of a socket fitting over the end of the adjustment shaft then it can be arranged that the outer surface of the socket is of a sufficiently larger diameter than the outer surface of the adjustment shaft to obstruct the radial projection.

Advantageously the radical projection is in the form of an arm which is spring biased in one direction longitudinally of the driven shaft so that if it is in an angular position to obstruct the fitting of the handle to the adjustment shaft it can be displaced sufficiently to allow fitting and operation of the handle. Thereafter the arm will be rotated from its obstructing position and then be rotated round to its abutting position.

Advantageously the clutch comprises a slipping clutch having a plurality of balls housed in a clutch member on the driven side and spring urged to engage between the teeth of a gear wheel constituting the driving member. For example a plurality of spring urged balls may be provided and which are angularly spaced about the axis of the gear wheel so that one or more but not all of them engage between the teeth of the gear wheel at any one time. Hence the setting of the driven shaft in relation to the driving member, i.e. the gear wheel, is finer than the pitch of the gear wheel teeth.

BRIEF DESCRIPTION OF THE DRAWINGS

The invention will now be further described by way of example with reference to the accompanying drawings in which.

DESCRIPTION OF THE PREFERRED EMBODIMENTS

Figure 1:
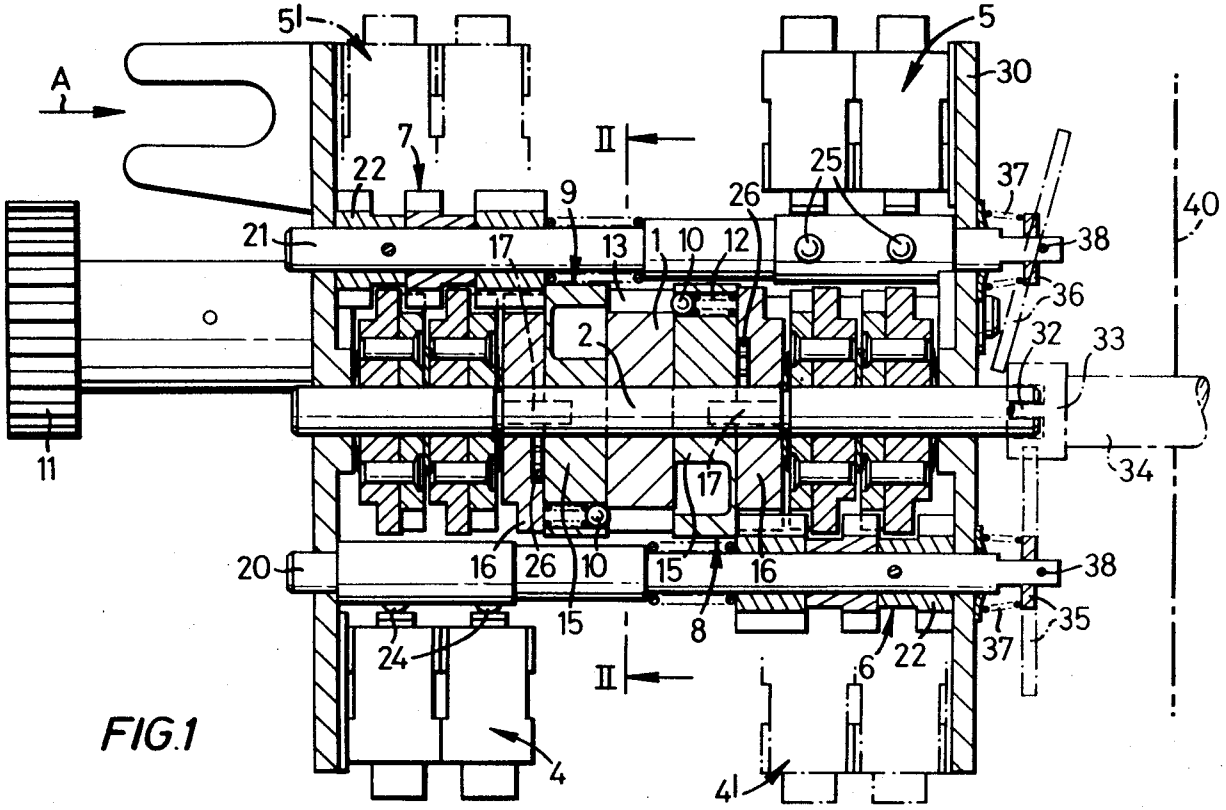
FIG. 1 shows a longitudinal sectional view of a switch actuating mechanism according to the invention.

The switch actuating mechanism is designed to operate two sets of limit switches shown at 4 and 5 in FIG. 1 and two sets of intermediate switches shown in chain-dotted lined at $4^1$ and $5^1$ in FIG. 1. Only the switch actuating mechanism for actuating the sets of limit switches 4 and 5 has been shown, the actuating mechanism for the intermediate switches $4^1$ and $5^1$ being of identical design and being disposed side-by-side with the actuating mechanism for the sets of intermediate switches $4^1$ and $5^1$.

The switch actuating mechanism has a driving member in the form of a driving gear 1 supported on and rotatable about a shaft 2 which extends on both sides of the gear wheel 1. The input drive to the driving gear 1 is through meshing gear wheel 3 (FIG. 2) which for example is drivingly connected for rotation with the output shaft of a valve actuator via a gear member 11 (FIG. 1).

The actuating mechanism shown is designed to operate the set of switches 4 when the driving gear 1 is rotated in one direction and to operate the second set of switches 5 when the driving gear is rotated in the opposite direction.

The driving gear 1 is drivingly connected on both sides to counter gear trains 6 and 7 via clutches 8 and 9. The clutches 8 and 9 are identically constructed and have balls 10 urged by springs 12 to engage between the teeth 13 of driving gear 1. The balls 10 and springs 12 are located in bores of clutch housings 15 and the clutch housings 15 are rotationally locked to the first counter gear members 16 of the gear trains 6 and 7 by pins 17.

Thus the gear trains 6 and 7 are drivingly connected to the driving gear 1 but the clutches 8 and 9 will slip if for example the driving gear 1 is held stationary while the gear trains 6 and 7 are turned.

Figure 2:
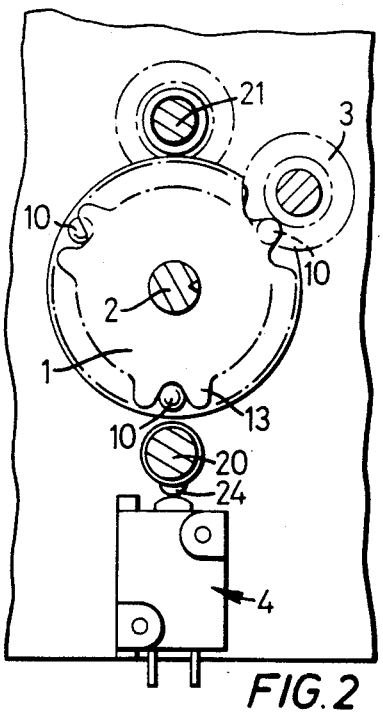
FIG. 2 is a section on the line II—II of FIG. 1.

As can be seen from FIG. 2 each of the clutches 8 and 9 has three balls 10 which are so angularly spaced from one another with respect to the axis of the driving gear 1 that only one of the balls 10 engage between the gear teeth 13 at any one time to form a driving connection between the driving gear 1 and the gear trains 6 and 7. Thus with the driving gear 1 held stationary the clutch can be clicked round one third of a tooth pitch at a time between one driving connection and the next to provide a fine adjustment of the gear trains 6 and 7 relatively to the driving gear 1 as will be described.

The gear trains 6 and 7 are of known construction fully described in the aforementioned U.S. Pat. No. 4,288,665. Suffice it to say for the purposes of the present description that continuous rotation of the driving gear 1 in one direction causes periodic rotation in one direction through a selected angle, for example 90°, of the output shafts 20 and 21 of the gear trains 6 and 7, the last counter pinions 22 of the gear trains 6 and 7 being pinned to the shafts 20 and 21. For continuous rotation of the driving gear 1 in the opposite direction of the output shafts 20 and 21 of the gear trains 6 and 7 are similarly periodically rotated in the opposite direction.

As can be seen in FIGS. 1 and 2 the shaft 20 carries actuating buttons 24 for the set of switches 4 and the shaft 21 carries actuating buttons 25 for the set of switches 5. In FIG. 1 the switch set 4 is shown as being actuated by the actuating buttons 24 while the actuating buttons 25 are angularly displaced about the axis of the shaft 21 from the switch set 5 by 90° clockwise viewed in the direction of arrow A in FIG. 1.

Figure 4:
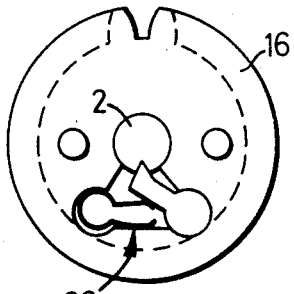
FIG. 4 shows a detail.

The first counter gear members 16 of the gear trains 6 and 7 are each rotationally connected to the shaft 2 through a spring loaded pawl mechanism 26, the construction of which is shown in FIG. 4 and which is fully described in the aforementioned U.S. Pat. No. 4,288,665. Thus as seen in FIG. 4 the counter gear member 16 can be rotated anti-clockwise relatively to the shaft 2; conversely rotation of the shaft 2 anti-clockwise will cause rotation of the counter gear member 16.

The pawl mechanism 26 associated with the gear train 6 is of opposite hand to that associated with gear train 7 so that for one direction of rotation of the shaft 2, say for convenience of description, clockwise as viewed in the direction of arrow A of FIG. 1, the counter gear member 16 of gear train 6 is locked for rotation to the shaft 2 and for anti-clockwise rotation of the shaft 2 the counter gear member 16 of the gear train 7 is locked for rotation to the shaft 2. This will not interfere with the operation of the actuating mechanism when operated by driving gear 1 since the shaft 2 will simply be rotated by the counter gear member 16 of gear train 6 for one direction of rotation and by gear train 7 for the opposite direction of rotation of driving gear 1.

The shaft 2 provides a means for selectively adjusting the gear trains 6 and 7 relatively to the driving gear 1 and hence of the actuation of switch sets 4 and 5 relatively to the position of a valve. Assume for example that the driving gear 1 is connected to rotate at a fixed ratio with the output shaft of a valve actuator and that it rotates a number of times in one direction during closing of the valve and the same number of times in the opposite direction during opening of the valve. Also assume that the switch set 4 is to be actuated at a predetermined point in the closing direction of the valve and that the switch set 5 is to be actuated at a predetermined point in the opening direction of the valve. First the valve is set by hand at the predetermined points in its closing direction at which the switch set 4 is to be operated and this sets the driving gear 1 in a predetermined position. The shaft 2 is then rotated clockwise to rotate the gear train 6 through the associated pawl mechanism 26 until the actuating buttons 24 on output shaft 20 are on the point of actuation of the set of switches 4 as shown in FIG. 1. During this rotation the clutch 8 is slipping as previously described. Also the gear train 7 remains stationary because its associated pawl mechanism 26 does not pick up the drive from shaft 2.

Then the valve is set at the predetermined point in its opening direction at which the switch set 5 is to be operated and this sets the driving gear 1 to a second predetermined position. The shaft 2 is then rotated anti-clockwise to rotate gear train 7 through the associated pawl mechanism 26 until the actuating buttons 25 on output shaft 20 are on the point of actuation of the set of switches 5. During this rotation the clutch 9 is slipping and the gear train 6 remains stationary.

Figure 3:
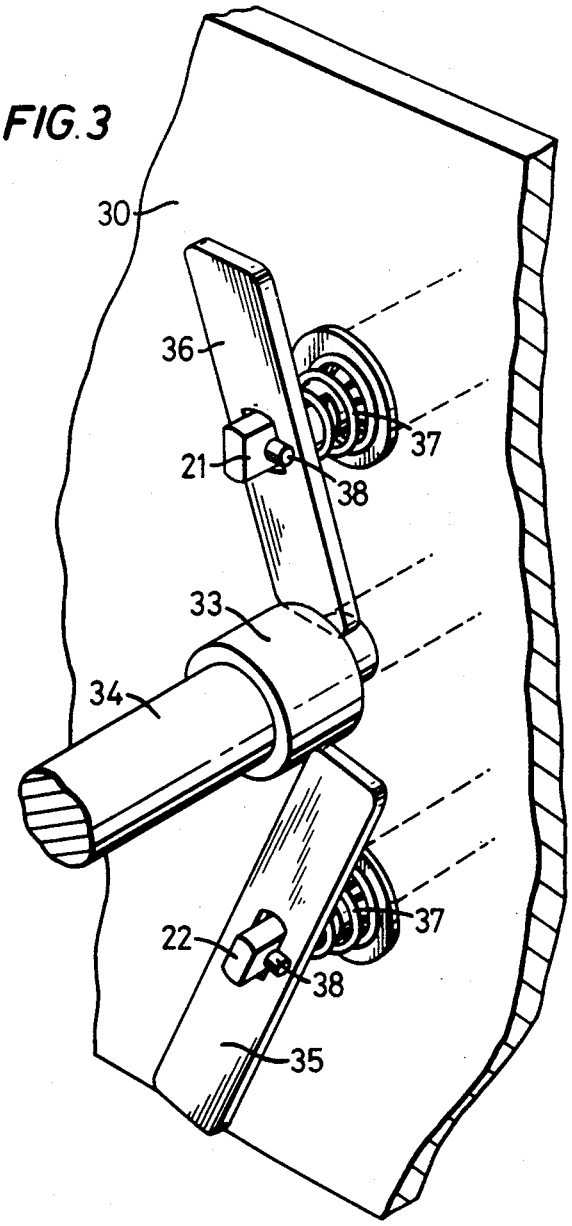
FIG. 3 is a perspective view illustrating the setting adjustment of the mechanism.

As best seen in FIG. 3 the projecting end of shaft 2 is provided with a transverse driving slot 32 which drivingly locates the socket head 33 of a handle 34 for manually rotating the shaft 2.

If the actuating buttons 24 and 25 and the switches 4 and 5 can be seen the actuating mechanism can be adjusted visually. If however they cannot be seen as for example when sealed in a valve actuator blind adjustment through rotation of the shaft 2 has to be effected. Thus as seen in FIG. 1 only the parts to the left of end plate 30 might be accessible namely the projecting ends of the shafts 2, 20 and 21. Alternatively the handle 34 might be the only part accessible outside a fluid-tight/explosion proof housing indicated at 40 of a valve actuator. In this case the handle 34 is permanently located in the driven shaft and its socket 33 is normally spring urged out of location with the driving slot 32 and is pushed against the spring force to drivingly connect with the slot 32. The handle 34 extends through a seal located in an aperture in the wall of the housing.

The ends of the shafts 20 and 21 are squared and extend through square apertures of arms 35 and 36 respectively so that the arms 35 and 36 are located on and rotate with the shafts 20 and 21. The arms 35 and 36 are urged by springs 37 away from the end plate 30 against pins 38 fitted toward the free ends of the shafts 20 and 21 so that the arms 35 and 36 can be displaced towards the end plate 30 against the spring force, for example tilted as shown for the arm 36 in FIGS. 1 and 3. The size of the apertures in the arms 35 and 36 is sufficiently large to permit this tilting.

As can be appreciated from FIGS. 1 and 3 the arms 35 and 36 can be rotated freely when the handle 34 is not fitted. However, when handle 34 is fitted its socket 33 provides an abutment which obstructs free rotation of the arms 35 and 36.

The angular positions of the arm 35 and actuating buttons 24 with respect to axis of the shaft 20 have a precise relationship so that when the actuating buttons 24 reach a predetermined actuating position in relation to the switches 4 during rotation of the shaft 2 by the handle 34 the leading edge of the arm 35 comes into abutment with the socket 33. In valve actuators it is usually required that the switches 4 are actuated just prior to the valve becoming fully seated to accommodate overrun without damage to the valve or its seating. Hence the angular positions of the arm 35 and the actuating buttons 24 is such that the buttons 24 will have just passed their actuating position when the leading edge of arm 35 comes into abutment with the socket 33. Similarly the arm 36 and the actuating buttons 25 have a precise angular relationship with respect to the axis of the shaft 21. This precise relationship can be adjusted by fitting arms 35 and 36 basically of different widths so that the relationships between their leading edges and the actuating buttons 24 and 25 are changed. Alternatively the relationship could be changed by changing the outside diameter of the socket 33.

To set the actuation of switches 4 assuming that the drying gear 1 has been set at its desired position the shaft 2 is rotated clockwise by handle 34 causing eventual anti-clockwise movement of shaft 20 and hence of arm 35 until its leading edge abuts the socket 33. Further rotation of handle 34 is not then possible since the gear train 6 is locked up. To set the actuation of the switches 5 the shaft 2 is similarly rotated anti-clockwise until the leading edge of the arm 36 abuts the socket 33.

If when the socket 33 is pushed on to shaft 2 either of the arms 35 and 36 obstructs the full location of the socket, the arm is merely tilted out of the way against the spring force as shown for the arm 36 in FIGS. 1 and 3. Eventually it will be rotated from beneath the end of the socket 33 and spring back to its normal position ready for abutment with the socket 33 to set the actuation of the associated switches.

I claim:

1. In an actuating mechanism comprising a driving member, a driven shaft and a transmission means comprising a gear train through which the driven shaft is driven by the driving member through a certain angle of rotation after a predetermined number of revolutions of said driving member, and actuating means carried by said driven shaft and operative at a predetermined angular position of said driven shaft, the improvement comprising in combination an adjustment shaft which can be manually rotated to rotate the driven shaft through the transmission means, a clutch connected between the driving member and the transmission means to permit, by disengagement of the clutch, the adjustment shaft to rotate the driven shaft relatively to the driving member and so set the actuating means relatively to the driving member, a radial projection on the driven shaft in a fixed angular relationship to the actuating means thereon, and a removable abutment stop for engagement by said radial projection at a predetermined angular position of said radial projection with respect to the axis of the driven shaft to limit the angular displacement of said driven shaft by said adjustment shaft.

2. An actuating mechanism according to claim 1, wherein said adjustment shaft has a projecting end which is disposed adjacent to and parallel to the driven shaft and the spacing of said projecting end from said driven shaft being such that the outer end of said radial projection can rotate past said projecting end of the adjustment shaft when said driven shaft is driven by said driving member and over which a socket member forming part of a handle is fitted for rotating said adjustment shaft, said socket member having an outer surface which provides said abutment stop by effectively increasing the diameter of said projecting end of the adjustment shaft so that it lies in the path of movement of the outer end of said radial projection.

3. An actuating mechanism according to claim 2, wherein said radial projection comprises an arm which is spring biased in one direction longitudinally of the driven shaft so that if it is in an angular position to obstruct the fitting of the handle socket to the adjustment shaft it can be displaced sufficiently along the driven shaft against the spring bias to allow operation of the handle to rotate said adjustment shaft.

4. An actuating mechanism according to claim 2, wherein said handle extends through a wall of the actuating mechanism behind which the ends of said adjustment shaft and said driven shaft are located and is spring urged out of driving engagement with said adjustment shaft.

5. An actuating mechanism according to claim 3, wherein said handle extends through a wall of the actuating mechanism behind which the ends of said adjustment shaft and said driven shaft are located and is spring urged out of driving engagement with said adjustment shaft.

6. An actuating mechanism comprising a driving gear wheel, a driven shaft, a transmission means comprising a gear train through which the driven shaft is driven by the driving gear wheel through a certain angle of rotation after a predetermined number of revolutions of said driving gear wheel, actuating means carried by said driven shaft and operative at a predetermined angular position of said driven shaft, an adjustment shaft which can be manually rotated to rotate the driven shaft through the transmission means, a clutch connected between the driving gear wheel and the transmission means to permit, by disengagement of the clutch, the adjustment shaft to rotate the driven shaft relatively to the driving gear wheel and so set the actuating means relatively to the driving gear wheel, said clutch being a slipping clutch having a plurality of balls housed in a clutch member on the driven side and spring urged to drivingly engage from the side of the driving gear wheel between the teeth of said gear wheel, a radial projection on the driven shaft in a fixed angular relationship to the actuating means thereon, and a removable abutment stop for engagement by said radial projection at a predetermined angular position of said radial projection with respect to the axis of the driven shaft to limit the angular displacement of said driven shaft by said adjustment shaft.

7. An actuating mechanism according to claim 6, wherein said plurality of balls are angularly displaced about the axis of the driving gear wheel at a spacing which is not proportional to the tooth pitch of the driving gear wheel so that one or more of the balls but not all of them engage between the teeth of the driving gear wheel at any one time, the remainder of the balls engaging the side of the driving gear wheel under the spring urging so that the clutch can be clicked round a fraction of a tooth pitch of the driving gear wheel at a time.

* * * * *